US006904689B2

(12) United States Patent
Sugita

(10) Patent No.: US 6,904,689 B2
(45) Date of Patent: Jun. 14, 2005

(54) GUIDE DEVICE

(76) Inventor: Toyohisa Sugita, 3-73 Hara-machi, Shinouku 162-0053 (JP)

( * ) Notice: Subject to any disclaimer, the term of this patent is extended or adjusted under 35 U.S.C. 154(b) by 112 days.

(21) Appl. No.: 10/659,783

(22) Filed: Sep. 9, 2003

(65) Prior Publication Data

US 2005/0051013 A1 Mar. 10, 2005

(51) Int. Cl.[7] ..... B43L 7/00

(52) U.S. Cl. ..... 33/428; 33/427; 33/480; 33/672

(58) Field of Search ..... 33/427–428, 452, 33/464, 474, 480, 520, 644, 670, 672

(56) References Cited

U.S. PATENT DOCUMENTS

| | | | | | |
|---|---|---|---|---|---|
| 229,283 | A | * | 6/1880 | Starrett | 33/428 |
| 249,821 | A | * | 11/1881 | Bellows | 33/428 |
| 738,422 | A | * | 9/1903 | Duffy | 33/428 |
| 1,188,018 | A | * | 6/1916 | Soisson | 33/428 |
| 4,380,872 | A | * | 4/1983 | Moran | 33/529 |

* cited by examiner

*Primary Examiner*—Christopher W. Fulton
*Assistant Examiner*—Tania Courson

(57) ABSTRACT

A guide device for cutting lap joints includes a frame and a rectilinear guide member, the frame having a Y-like shape and consisting of a removable top portion and a bottom portion forming a yoke therebetween at the upper portion of the Y-like frame. The lower portion of the Y-like frame has a guide portion and one side of the guide portion extends to be co-linear with one side of the yoke portion forming a first adjustable guide surface. The guide portion is provided with a guide way running longitudinally along the guide portion with a movable stopper provided so as to move along the guide surface as guided by the guide way. The movable stopper has a lockable member for locking the movable stopper in any desired position along said guide surface. The other side of the guide portion opposite to the guide surface forms an angle of 45 degrees with another contiguous side of the yoke portion and a fixed stopper is formed near the junction of the yoke portion and this other side of the guide portion. The rectilinear guide member is removably inserted within the yoke, extending perpendicular to the adjustable guide surface, a bottom edge thereof forming a 45 degree angle with said fixed stopper.

2 Claims, 11 Drawing Sheets

GUIDE DEVICE

BACKGROUND OF THE INVENTION

1. Field of the Invention

This invention relates to novel guide device for cutting lap joints with a router or laminate trimmer, and more particularly to a lap joint jig by which lap joints can be easily cut with exceptional accuracy in a very short time. The jig enables hobbyists to produce professional looking lap joints without the need for various templates, fences, or complicated procedures. The present jig also allows a number of lap joints to be produced continuously so that a number of framing projects, etc. can be accomplished on a scale approaching mass production.

2. Description of the Related Art

Miter joints, as represented in FIG. 8, are one method of making rectangular frames, etc., but they are difficult to make accurately, even more difficult to make visually attractive and tend to be relatively weak. As an alternative, lap joints are a professional method of producing frames for pictures, doors, etc., by which the end grain of the wood along the sides of the frame can be hidden, while achieving an incredibly strong frame joint. The work of forming lap joints for picture frames, etc., has been performed in several ways, all of them requiring a number of steps and adjustments that introduce inaccuracies into the work. These processes make forming a frame that is square, strong and elegant a daunting task for all but the most experienced wood workers, both hobbyist and professional alike. For example, as shown in FIGS. 9 and 10 one conventional method requires three templates, a 90 degree and 45 degree right and left hand templates 21, 22 & 23 respectively. First, one of the templates is placed on a workpiece 24 and a cut 25 is formed by a rotary bit of a router 28 which is rested on the template, as seen in FIG. 11. The bit of the router must be run along the edge of the template while the router is held firmly on top of the template. This is not very easy to do as the router is only partially supported on the template, as shown in the figure, easily ending up in uneven cuts as a result of a tilted router. Another conventional method of making lap joints is with the use of dado blades 29 as shown in FIG. 12. However, one of the disadvantages of this method is the need to make an accurate cut at the starting point, a technique that requires a good eye and steady feed of the workpiece into the dado blades. As a result, inaccurate corner points or variances in the mitered cut mar the resultant frame with poor fit and reduced strength. Further, other methods using guides or fences have been proposed, but all suffer from being very complicated and inaccurate.

To overcome these problems, the present inventor developed, a novel guide device or jig for cutting lap joints by which extremely accurate lap joints can be easily formed without the need for templates, measurements or a variety of special fences.

SUMMARY OF THE INVENTION

The present invention has been made with a view to solve the problems stated above and its object is to provide a guide device for cutting lap joints and more particularly to a lap joint jig by which lap joints can be accurately and easily formed.

According to this invention, a guide device or jig for cutting a lap joint is provided which includes a rectilinear guide member or offset blade held within a frame. The frame is in a generally Y-shaped configuration and comprises a yoke portion at the top of the Y for holding the rectilinear guide member or offset blade in the first stage of preparing a lap joint, and a guide portion in the stem or leg of the Y for guiding a movable member or stopper, the movable stopper being lockable along the guide portion. The guide portion extends to be co-linear with one side of the yoke portion with the movable stopper extending perpendicular to thereto, forming a first adjustable guide surface. The other side of the guide portion forms an angle of 45 degrees with the other side of the yoke. A fixed stopper is formed near the junction of the yoke and this other side of the guide portion, the fixed stopper describing a 90 degree angle with this side of the yoke, with the apex of the angle set to be along the plane of the bottom of the offset blade when inserted.

DESCRIPTION OF THE PREFERRED EMBODIMENTS

Preferred embodiments of a guide device for lap joints according to this invention will be described hereunder with reference to the drawings.

Figure 1:
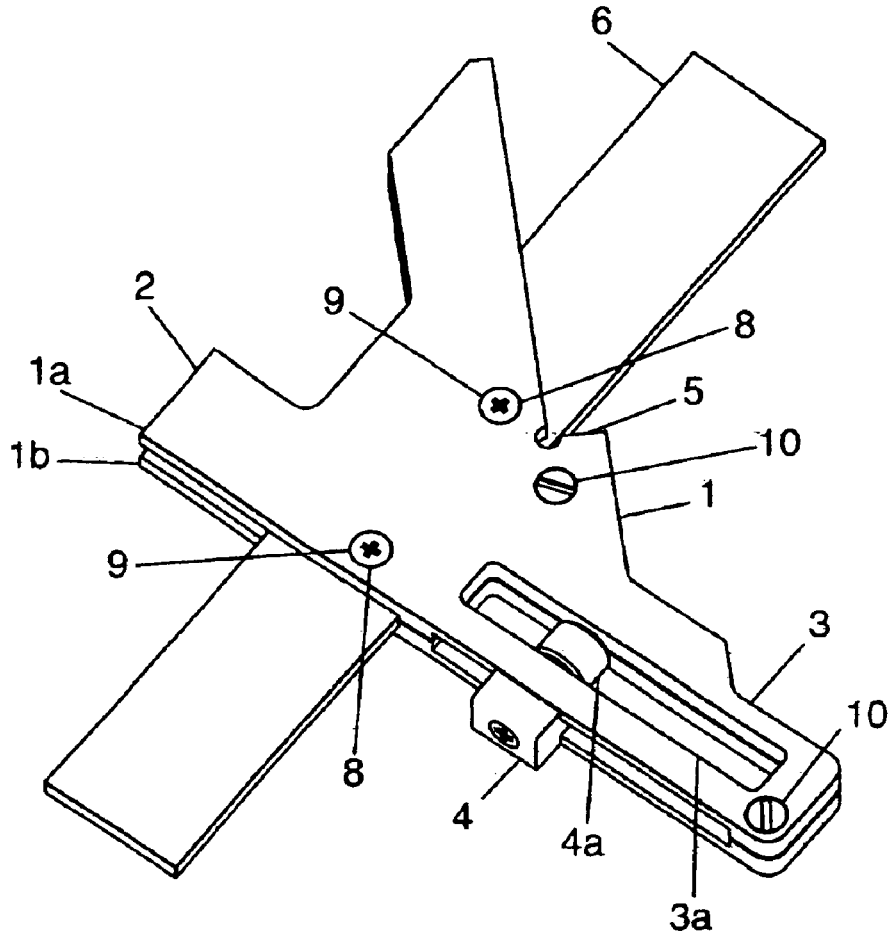
FIG. 1 is a perspective view of a principal portion of the present device, the view also showing the offset blade as inserted in the yoke.
Figure 2:
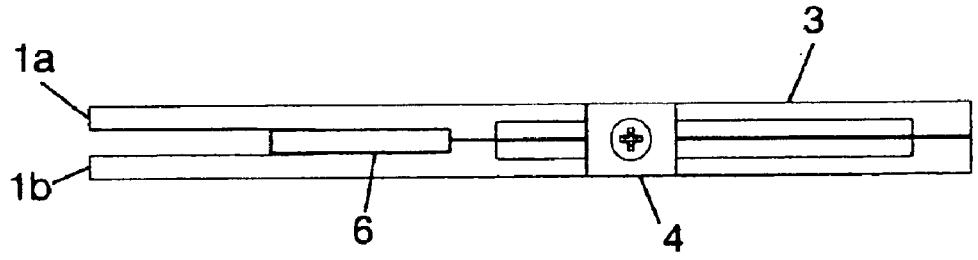
FIG. 2 is a side view of the present device shown in FIG. 1.
Figure 7:
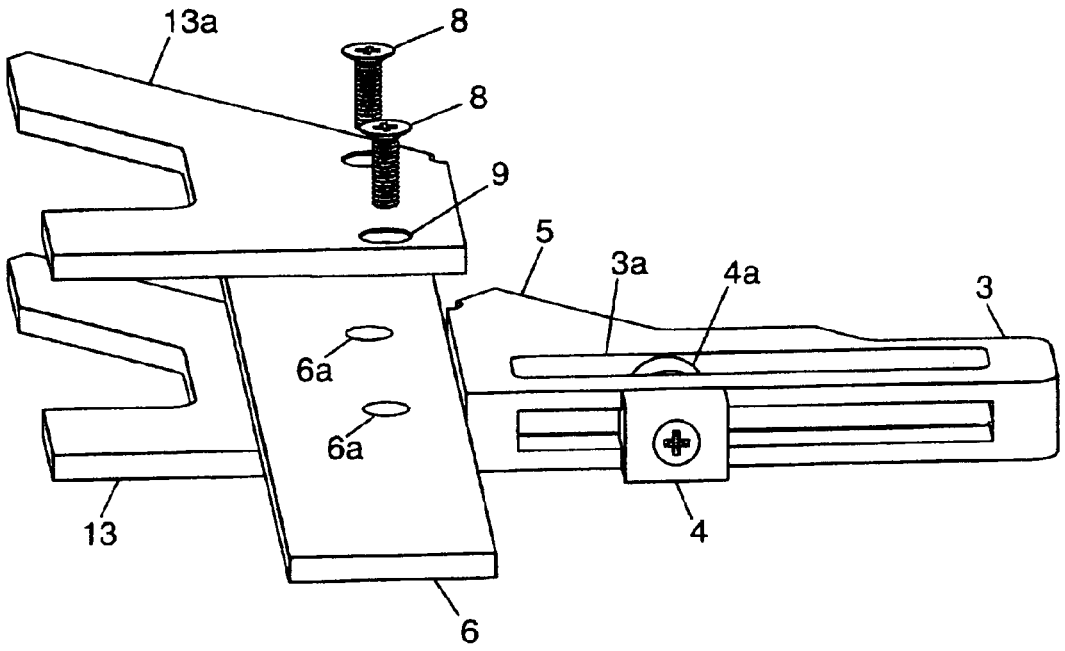
FIG. 7 is a perspective view of another embodiment of the invention.
Figure 8:
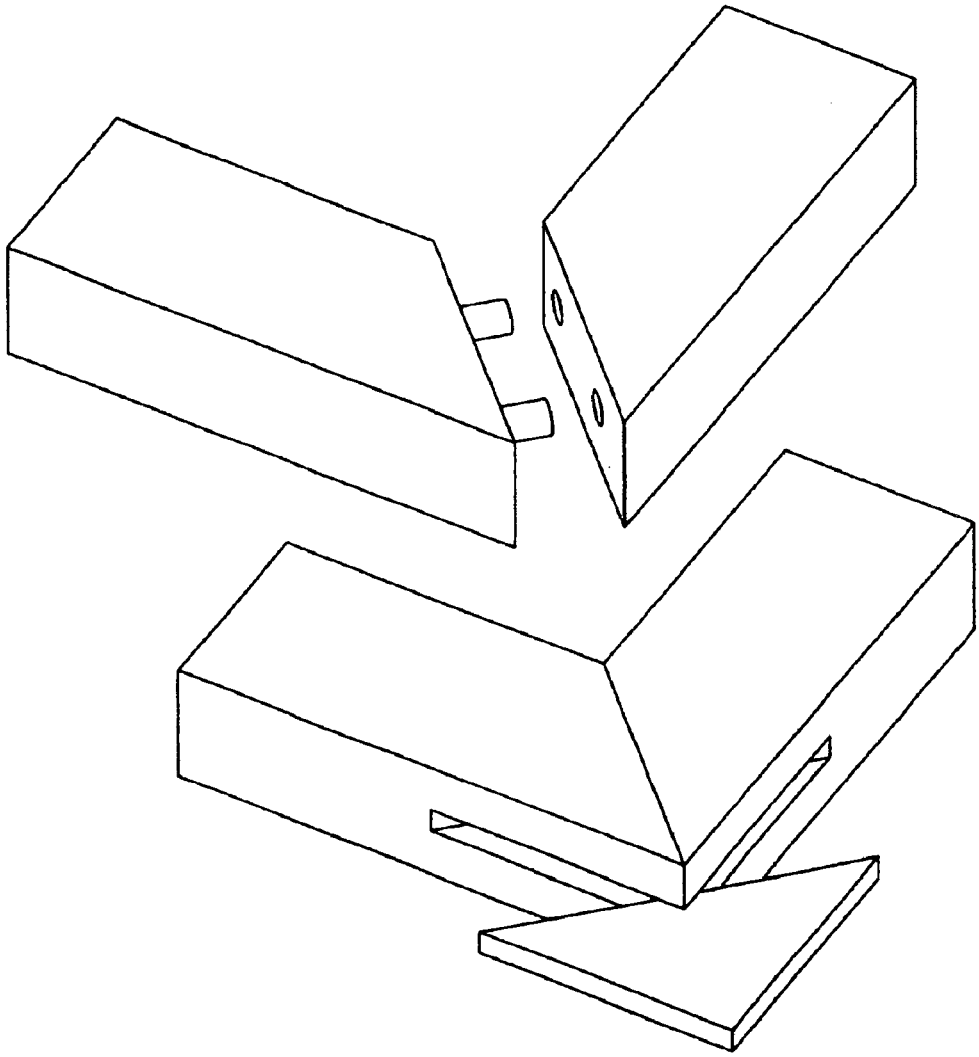
FIG. 8 is a view of two types of conventional miter joints.
Figure 9:
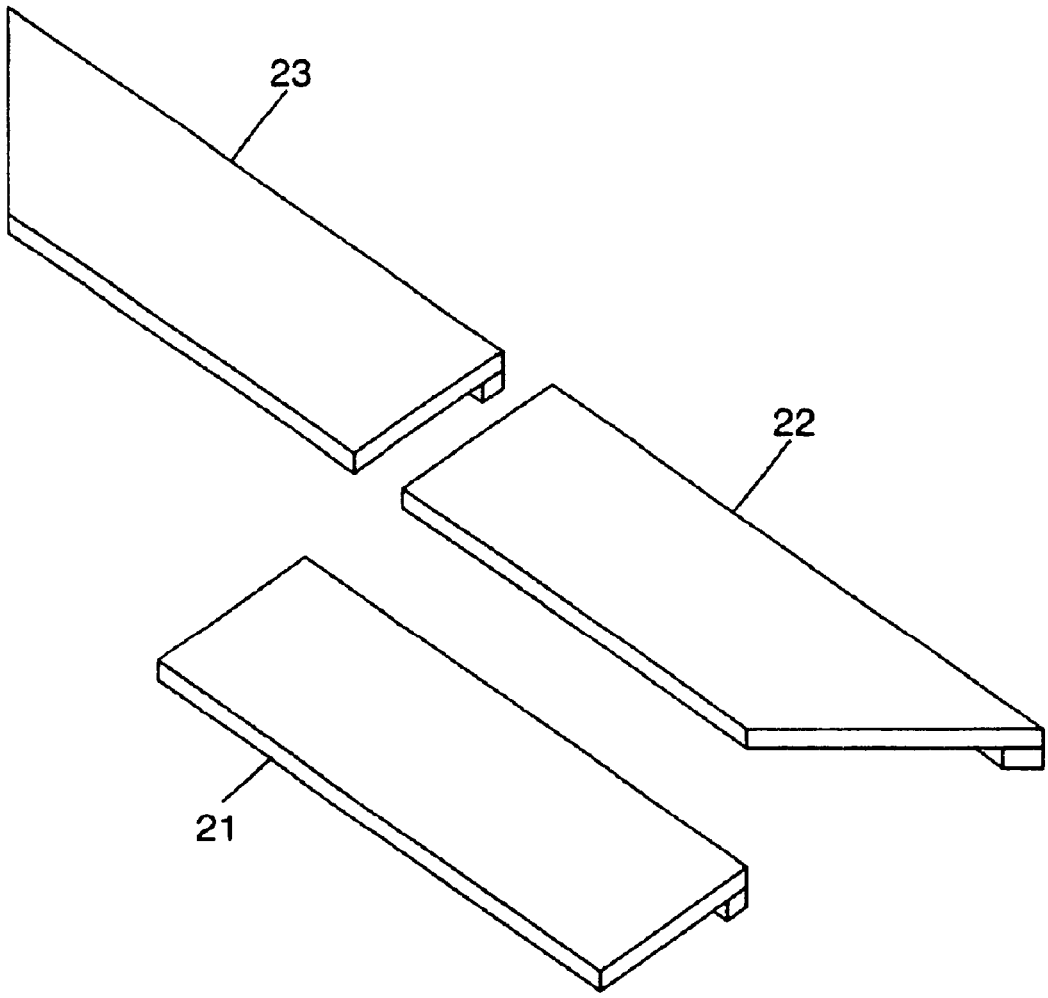
FIG. 9 is an explanatory view of templates used in a prior method of cutting a lap joint.
Figure 10:
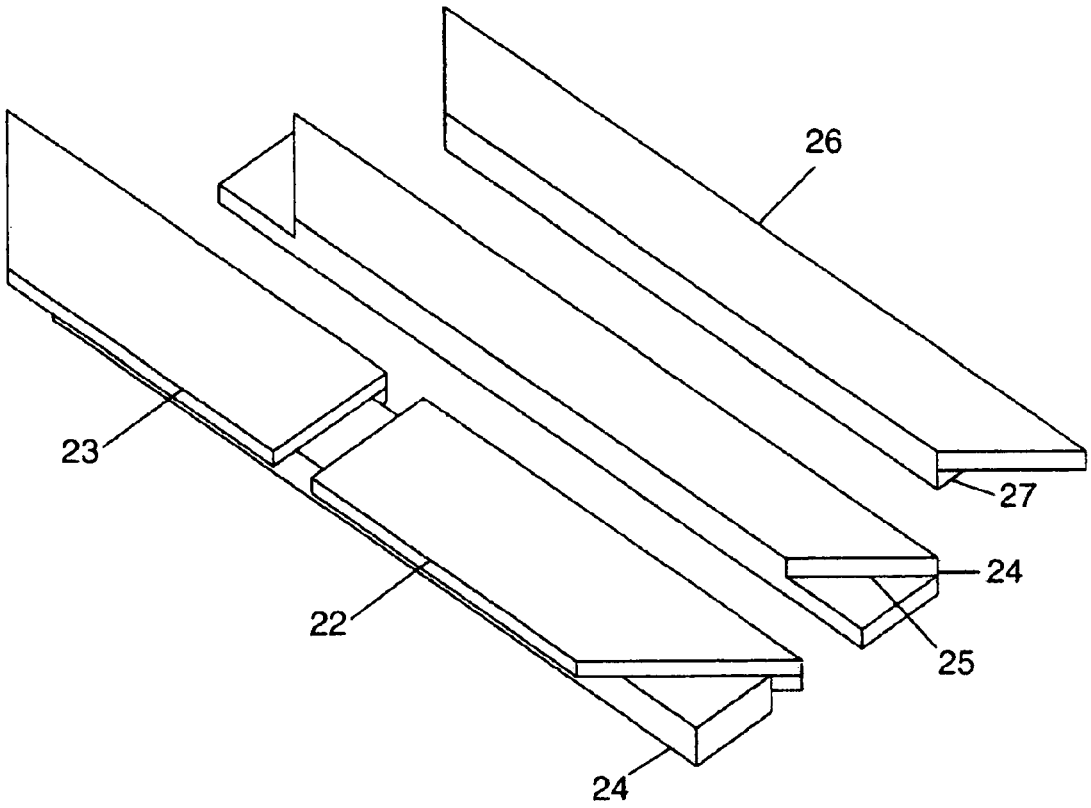
FIG. 10 is an explanatory view describing a prior method of cutting a lap joint using templates.
Figure 11:
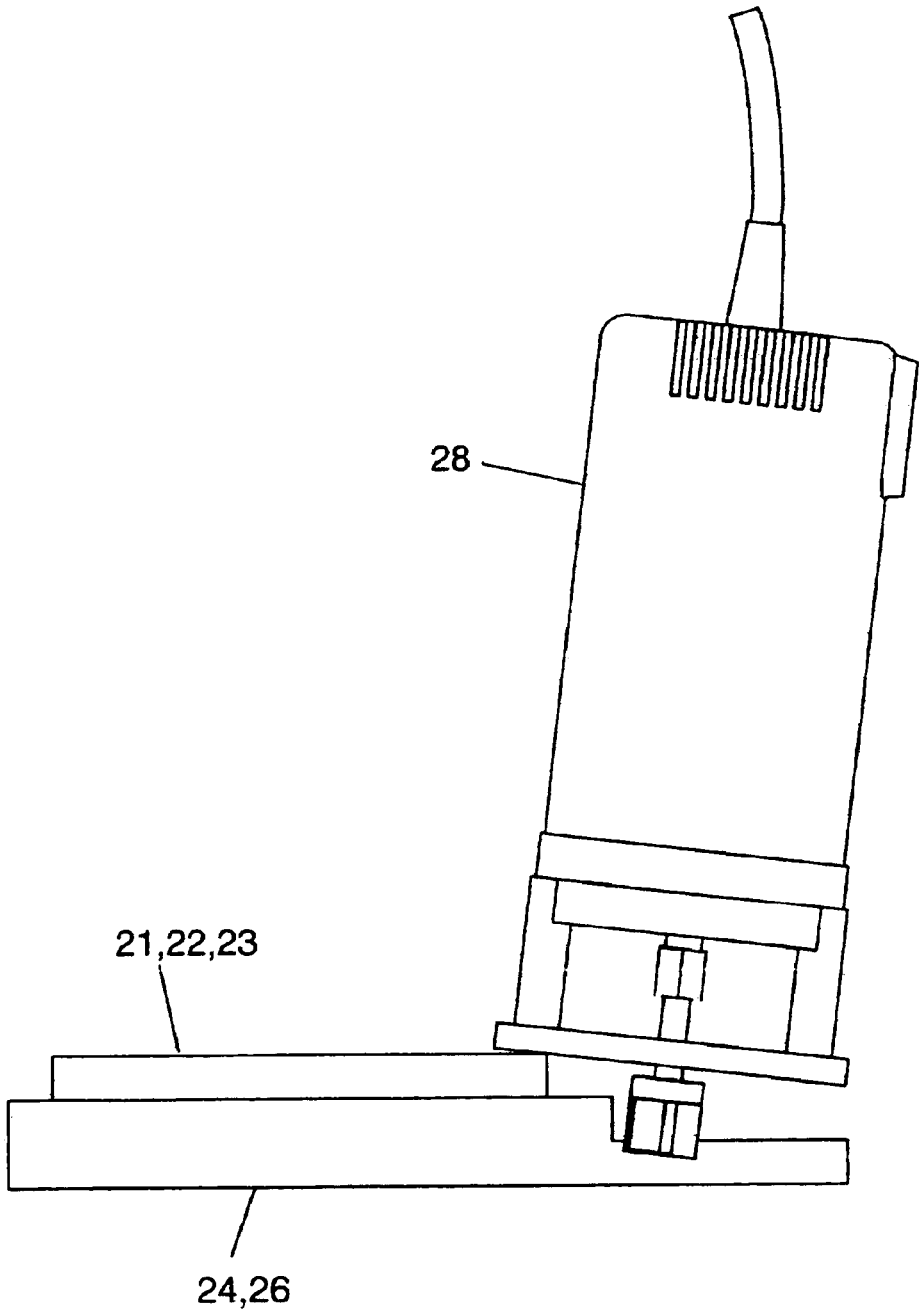
FIG. 11 is an explanatory view further describing the prior method of cutting a lap joint.
Figure 12:
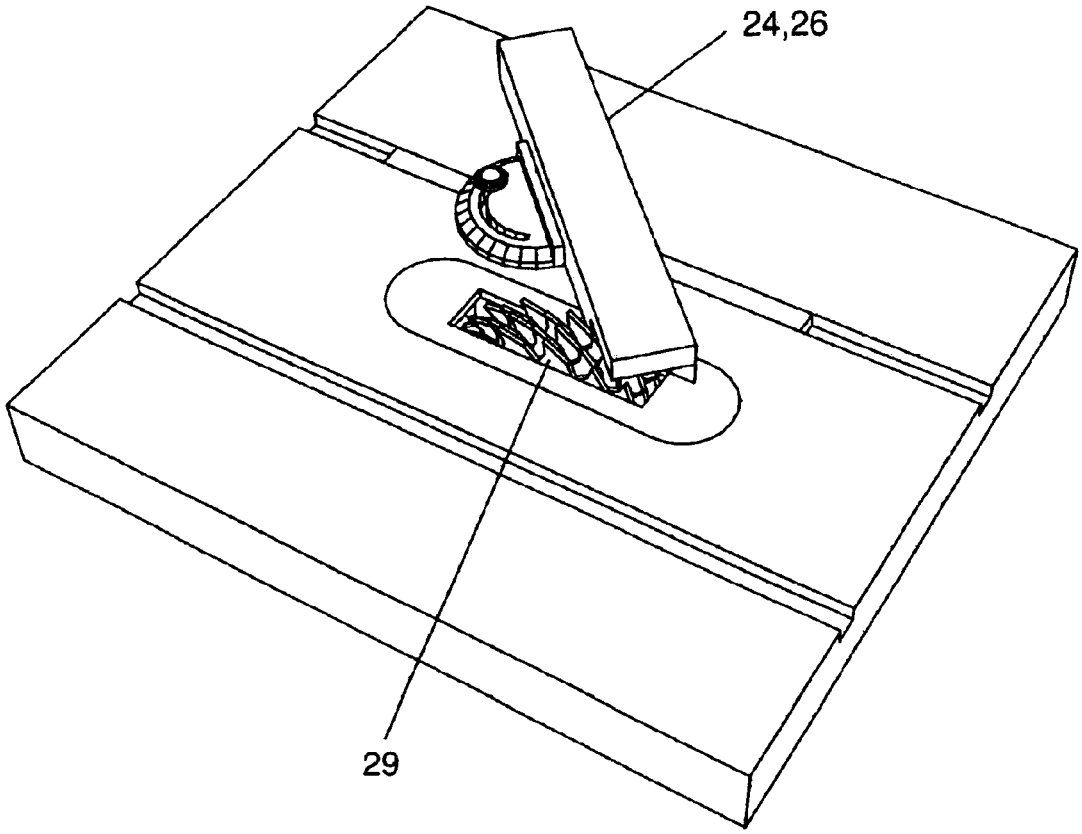
FIG. 12 is an explanatory view describing another prior method of cutting a lap joint.

In FIG. 1, one embodiment of the jig is shown in which 1 denotes a frame, the frame 1 consisting of a top portion 1*a* and a bottom portion 1*b*, 2 denotes a yoke portion of the frame (better viewed in FIG. 2), 2*a* being a removable portion of the frame, 3 is a guide portion of the frame with 3*a* being a guide way for a movable stopper 4. A locking member 4*a* is provided in the movable stopper 4 so that the movable stopper may be locked in any position along the guide way 3*a*. On the opposite side of the guide portion a fixed stopper 5 is formed. An offset blade 6 is comprised of a suitably trimmable material such as plastic with a pair of guide holes 6*a*, 6*a* (as shown in FIG. 7) for fixing the guide member in the yoke. A pair of guide pins 8, 8 appropriately spaced from each other are provided in a pair of guide holes 9, 9 opened in the yoke portion of the frame 1 by suitable methods such as by press fitting. Guide pins 8 may also be screws removably threaded into the yoke 2. Screws 10 are provided to hold the top and bottom portions 1*a*, 1*b* of the frame 1 together. In this way, the top portion 1*a* of the frame may be removed for insertion or removal of the offset blade 6.

As can be seen from the drawings, the jig forms a sort of modified Y, with one arm of the Y extending at 45 degrees in relation to the foot of the Y and the other arm extending in a co-linear relationship with the leg or stem of the Y, to form a straight surface with the guide portion 3.

Figure 3:
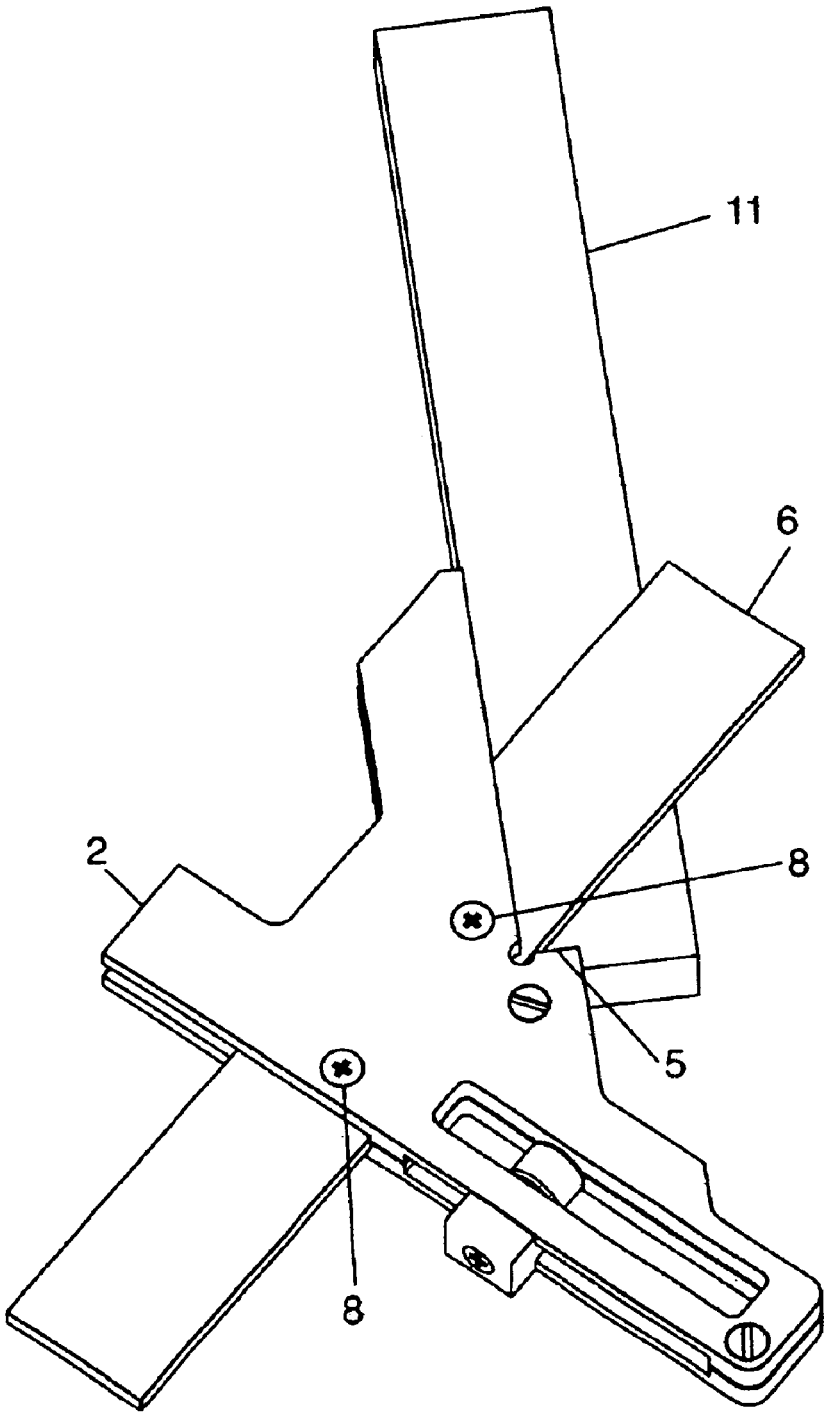
FIG. 3 is a perspective view for explaining a method of cutting a lap joint using the present invention.
Figure 4:
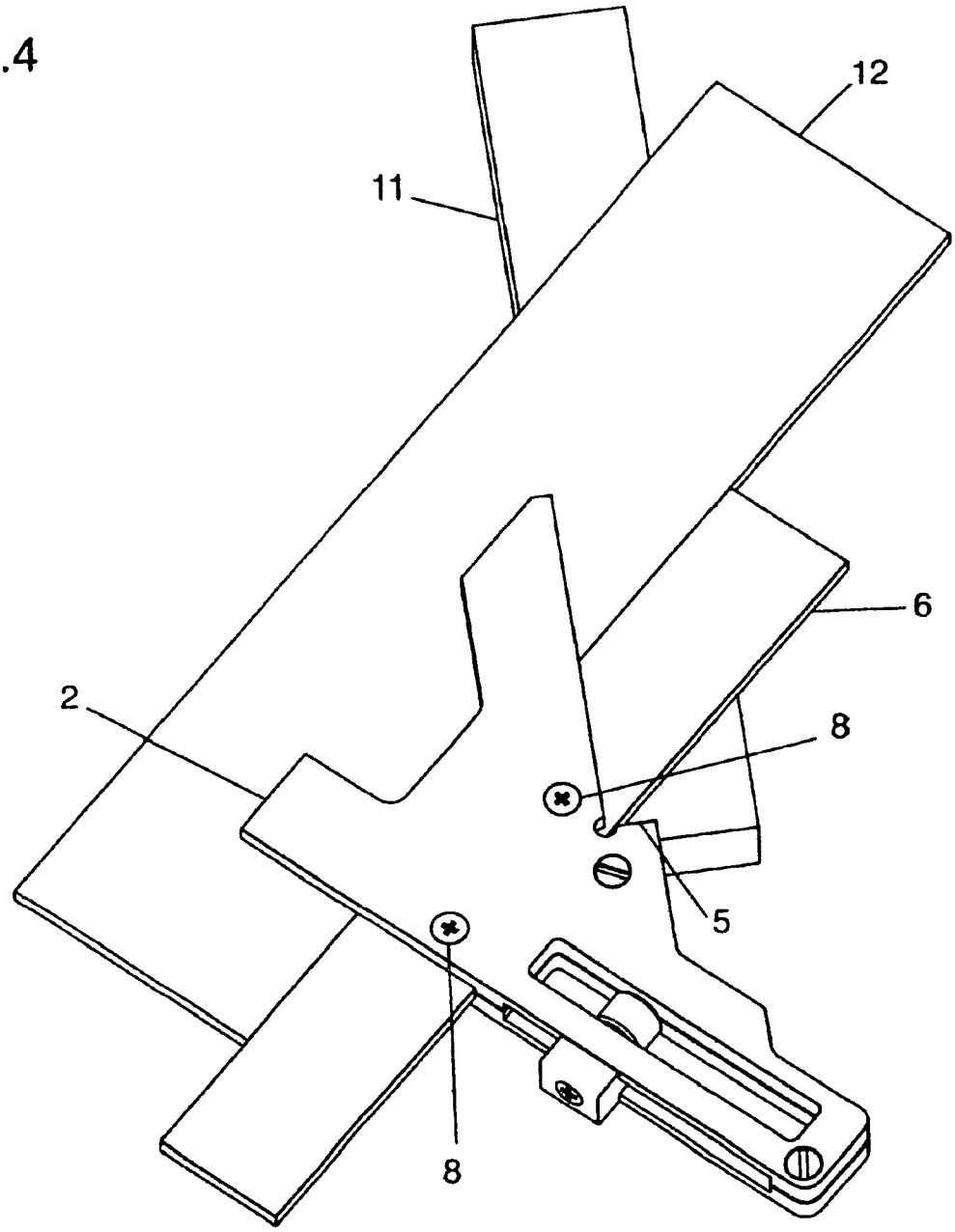
FIG. 4 is a perspective view for further explaining a method of cutting a lap joint using the present invention.

The operation of this embodiment will be described below. As shown in FIGS. 1 & 3, the offset blade 6 is inserted into the yoke portion 2 by first removing top portion 1*a*. The top portion is then reattached to fix the offset blade 6 on the guide pins or screws 8. Here it must be explained that the offset blade 6 can either be of a trimmable material or made to be an exact width for use with a particular make of laminate trimmer as will be explained in more detail later. Next, a work piece 11 or picture frame side in this example, is inserted along the 45 degree side of the Y to rest against the fixed stopper 5. Then, a fence 12 is inserted into the yoke to ride along the top side of the offset blade 6, as seen in FIG. 4 and clamped onto the work piece 11 by a c-clamp, for example. As can be understood from the drawings, the inside corner of the work piece 11 lays along the edge of the offset blade so that the fence 12 is spaced the width of the offset blade from the end corner of the work piece 11, to form a 45 degree angle therewith. The clamped fence 12 and work piece 11 are then removed from the frame 1 maintaining their 45 degree relationship.

Figure 5:
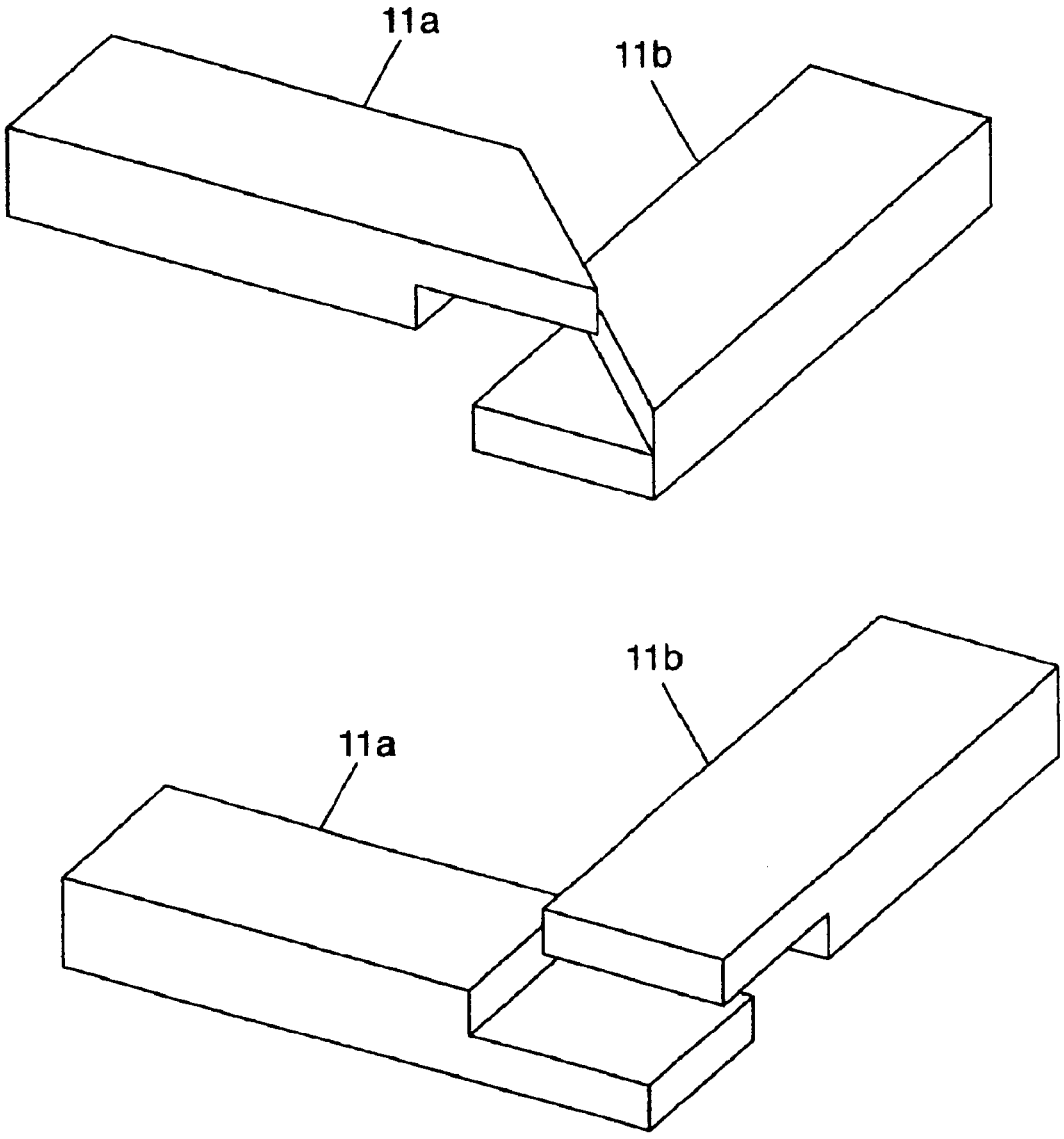
FIG. 5 is a view of two types of lap joints that can be made using the present invention.

As seen in FIG. 5, two types of lap joints are particularly facilitated by using the jig of the present invention. Both types of lap joints are not only inherently strong, but useful for making picture frames, door frames and the like. With the fence clamped to the work piece 11 as described above, a mitered half-lap joint can be easily produced in the rail by cutting with a laminate trimmer along the work piece 11 while guiding the edge of the trimmer along the fence clamped to the work piece at precisely 45 degrees. Since the offset blade is either trimmed or initially made to be the same width as the distance from the edge of the trimmer to the closest edge of the cutting blade, guiding the trimmer along the fence will give an exact cut at 45 degrees along a line that runs accurately through the apex of the corner of the work piece 11. This accurate cut performed on all four frame sides will provide a frame with the first cuts for making close fitting half lap joints having very accurate mitered points. The depth of cut is adjusted on the trimmer according to normal practice in order to give a flat surface to the finished frame, usually to cut down to half the thickness of the workpiece.

Figure 6:
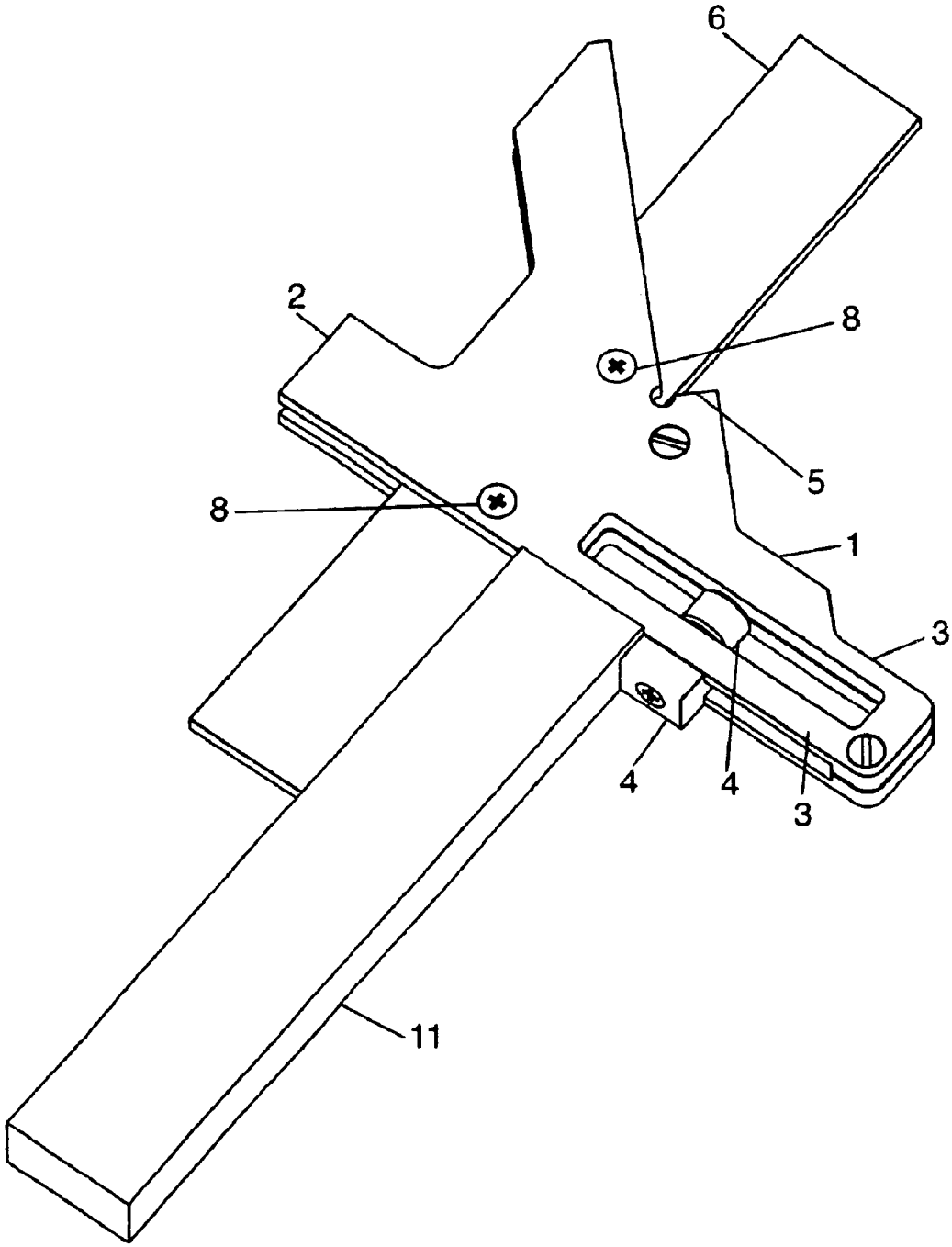
FIG. 6 is a plan view of the present device showing the use of the movable stopper.

However, to finish the mitered half-lap joints, a square cut is also needed on the two work pieces 11 that are to become stiles 11*a* for a picture frame in this embodiment, the remaining two sides being rails 11*b*. The square cuts are performed by using the movable stopper 4 with the offset blade 6 installed as before. First, as shown in FIG. 6, the end of a work piece 11 is placed against the straight surface formed along the guide portion 3, with the long side of the work piece 11 riding along the offset blade 6. The movable stopper 4 is then moved snugly against the other long side of the work piece 11 and locked in place by the locking member 4*a*, and then the work piece 11 is removed. Therefore, it can be seen that this sets the distance from the offset blade 6 to the inside edge of the stopper 4 to be the same as the width of any of the work pieces 11. Next, the stile to be cut is set lengthwise along the straight surface of the frame 1 with the end thereof resting against the locked movable stopper 4, the distance between the edge of the offset blade and the end of the stile 11*a* being equal to the width of any work piece 11. The stile is then clamped to the offset blade with a c-clamp or the like to maintain this distance, and the fence 12 is then inserted into the yoke to ride along the top of the offset blade 6 as before. The fence is then firmly clamped to the stile 11*a* and the clamp holding the blade 6 to the workpiece is released to allow the frame 1 to be removed from the clamped stile and fence. Again, using the trimmer adjusted to the correct depth, a square cut is performed guided by the fence allowing a straight accurate cut on both stiles to complete mitered half-lap joints.

Further, it goes without saying that end-lap joints can be cut by just performing the above procedure using the straight surface for square cuts on all work pieces. Also, it can be seen that only one fence setting is required using the device if the other work pieces are aligned and clamped alongside the work piece.

In FIG. 7, another embodiment of the jig is shown in which 13*a* is a removable portion of the yoke 13. Here the guide pins 8 are preferably screws removably threaded into the yoke 13. In this way, only the removable portion 13*a* of the yoke need be removed for insertion or removal of the offset blade 6.

The operation of this embodiment will be described. As shown in FIG. 7, the offset blade 6 is inserted into the yoke portion 13 by first removing removable portion 13*a*. The removable portion is then reattached to fix the offset blade 6 on the guide pins or screws 8. This makes the fixing of the offset blade more convenient without the need to remove all of the top portion 1*a* of the frame.

As can be seen from the above, the present guide device for lap joints greatly facilitates the process of cutting both mitered half lap joints and end lap joints without the use of the templates, multiple fences, t-squares, etc. that are conventionally used. This allows reductions in both time spent making frames and in the number of inaccuracies that are inherently introduced with conventional methods. It provides even hobbyist woodworkers with a tool that allows the cutting of joints that are crisp, accurate and flush, resulting in frames with surprisingly professional appearance. The device is also compact, size being regulated only by the width of frames to be produced, so that storage is much less of a problem than encountered by using conventional methods. Further, due to the provision of both the movable stopper and fixed stopper, only one device is needed for a variety of frame projects, a versatility that can be appreciated by hobbyist with limited resources and/or space. Also, when the removable portion is provided, offset blade changes can be carried out rapidly making it easier to use different blades for a variety of trimmers or projects.

What is claimed is:

1. A guide device for cutting lap joints which includes a frame and a rectilinear guide member, said frame having a Y-like shape and consisting of a removable top portion and a bottom portion forming a yoke therebetween at the upper portion of the Y-like frame, the lower portion of the Y-like frame forming a guide portion, one side of the guide portion extending to be co-linear with one side of the yoke portion forming a first adjustable guide surface, the guide portion being provided with a guide way running longitudinally along the guide portion, a movable stopper provided so as to move along the guide surface as guided by the guide way, the movable stopper having a lockable member for locking the movable stopper on said guide way in any desired position along said guide surface, another side of the guide portion opposite to the guide surface forming an angle of 45 degrees with another contiguous side of the yoke portion, a fixed stopper being formed near the junction of the yoke portion and this other side of the guide portion, the rectilinear guide member being removably inserted within said yoke to extend perpendicular to said adjustable guide surface, a bottom edge thereof forming a 45 degree angle with said fixed stopper.

2. A guide device as provided in claim 1 wherein only one section of the top portion of the frame is removable, the removable portion essentially comprising the upper half of the yoke portion, thereby forming a yoke between the removable portion and the bottom portion of the Y-like frame.

* * * * *